US006513357B2

(12) United States Patent
McCurry

(10) Patent No.: US 6,513,357 B2
(45) Date of Patent: Feb. 4, 2003

(54) KEY RETENTION MECHANISM FOR MAIL LOCK BOX

(75) Inventor: Ronald McCurry, West Union, SC (US)

(73) Assignee: CompX International Inc., Mauldin, SC (US)

( * ) Notice: Subject to any disclaimer, the term of this patent is extended or adjusted under 35 U.S.C. 154(b) by 0 days.

(21) Appl. No.: 09/853,208

(22) Filed: May 11, 2001

(65) Prior Publication Data

US 2001/0039819 A1 Nov. 15, 2001

Related U.S. Application Data

(60) Provisional application No. 60/203,563, filed on May 11, 2000.

(51) Int. Cl.[7] ..... E05B 11/00

(52) U.S. Cl. ..... 70/389; 70/390; 70/429; 70/DIG. 9; 70/DIG. 63

(58) Field of Search ..... 70/389, DIG. 9, 70/429, 441, DIG. 63, 390

(56) References Cited

U.S. PATENT DOCUMENTS

| | | | | | |
|---|---|---|---|---|---|
| 98,736 | A | * | 1/1870 | Berolzheimer | |
| 1,212,599 | A | * | 1/1917 | Ziehler et al. | |
| 1,227,425 | A | * | 5/1917 | Gonsalves | |
| 1,239,244 | A | * | 9/1917 | Wyckoff | |
| 1,256,721 | A | * | 2/1918 | Murray | |
| 1,310,834 | A | * | 7/1919 | King | |
| 2,220,786 | A | * | 11/1940 | Grainger | |
| 2,760,319 | A | * | 8/1956 | Just | |
| 3,336,773 | A | * | 8/1967 | Oechslin | |
| 4,315,420 | A | * | 2/1982 | Oliver | 70/379 R |
| 4,341,100 | A | * | 7/1982 | Kohlhage | 70/63 |
| 4,416,413 | A | * | 11/1983 | Chester | 70/389 X |
| 4,433,787 | A | * | 2/1984 | Cook et al. | 70/235 X |

FOREIGN PATENT DOCUMENTS

| | | | | |
|---|---|---|---|---|
| GB | 1500003 | * | 2/1978 | 70/389 |

* cited by examiner

*Primary Examiner*—Lloyd A. Gall
(74) *Attorney, Agent, or Firm*—Banner & Witcoff, Ltd.

(57) ABSTRACT

A customer key actuated lock includes a retention mechanism which prevents counterrotation of the customer key plug to roation from the locked position toward the unlocked position and further includes a release mechanism to disengage the retention mechanism.

9 Claims, 10 Drawing Sheets

FIG.4
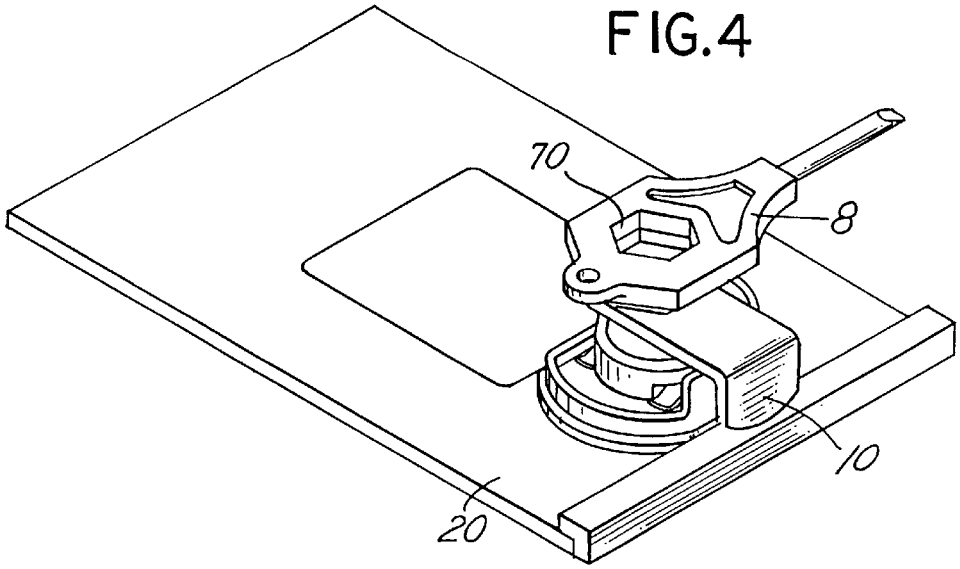
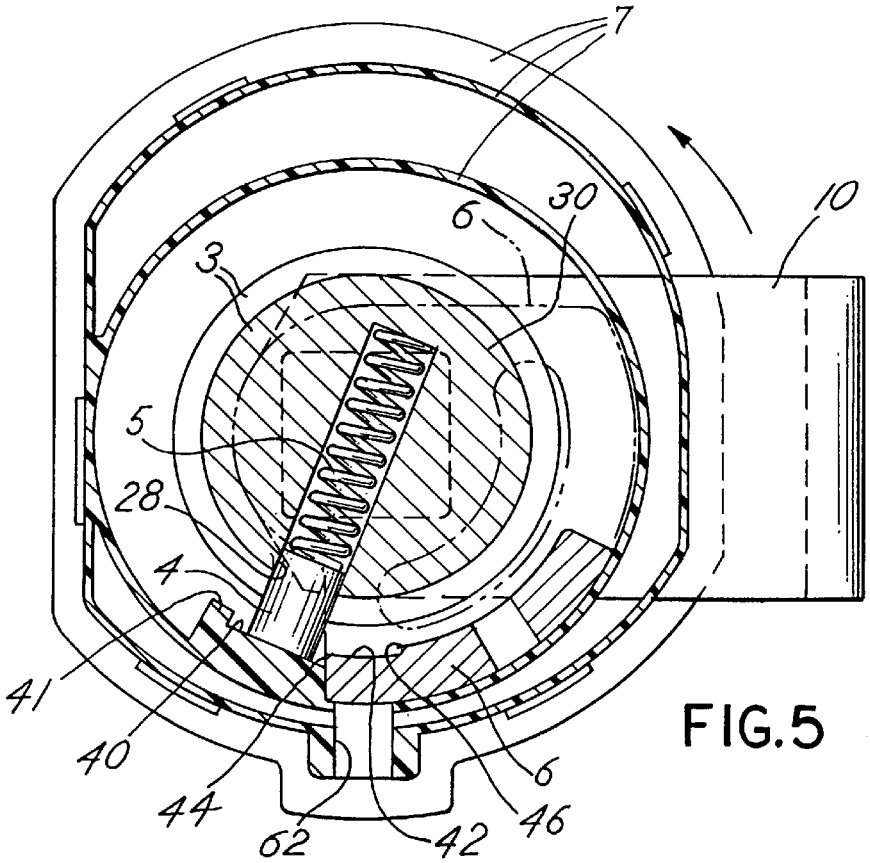
FIG.5

KEY RETENTION MECHANISM FOR MAIL LOCK BOX

CROSS REFERENCE TO RELATED APPLICATION

This is a utility application based upon provisional application Ser. No. 60/203,563 filed May 11, 2000 for which priority is claimed.

BACKGROUND OF THE INVENTION

In a principal aspect the present invention relates to a lock and, more particularly, to a lock which is useful as an approved postal box lock.

Postal lock boxes typically include a key-actuated tumbler lock, which enables the postal patron or customer to achieve access to the lock box on a one-time basis. The lock box is designed to permit the postal patron to have one time access to the box in order to remove the contents thereof subsequent to obtaining the lock box key from a postal employee. In such a circumstance, the patron has the opportunity to use an appropriate key obtained from a postal worker to unlock the lock box, release the bolt from the lock box strike and thereafter open the lock box door for access to the contents. Upon opening the lock box door, however, it is desired to capture the customer key in the lock and preclude closing of the lock box door. The patron can then remove the contents of the lock box, leaving the key in the lock box door lock. Thereafter, a post office employee may retrieve the patron or customer key and return it to the post office repository after closing and relocking the lock box. The customer key may then again be made available to the postal patron from post office personnel at which time postage due, delivery charges, etc. may be paid in order to permit the patron to again receive the key and gain access to the lock box. Once the customer key is received by the patron the cycle may be repeated. That is, the patron may go to his or her lock box, open the box, remove the contents leaving the key in the lock associated with the lock box. The postal employee will again close and lock the box as well as retrieve the key.

For example, the U.S. Postal Service has specifications and criteria for such locks under the postal service identification No. 0306P key lock assembly, P/ND-1002980. Such locks typically require a postal worker to reset or release of the customer key from the lock and reset the lock to the locked position.

Providing a system which will enable postal employees to retrieve a customer key and lock the lock box after a postal patron has utilized the lock box is thus a desirable goal and need with respect to such postal lock boxes. Moreover, other businesses may desire to utilize such a lock system where, in order to have access to a particular lock box, the patron must first acquire the customer key from a qualified or a certified employee associated with an establishment. Such a protoscol provides an incentive and protocol for the patron to clear all accounts or otherwise attend to appropriate matters of business before obtaining access to a lock box. Needs of this nature have inspired the development of the present invention.

SUMMARY OF THE INVENTION

Briefly, the present invention relates to a lock construction with a customer lock plug and associated bolt which, when rotated by means of a customer key from the locked position toward the unlocked position will be precluded from counterrotation unless and until a release mechanism is effected.

Removal of the customer key is also precluded until the plug is counterrotated to the fully locked position. Various release mechanisms are disclosed. For example, the lock may include a special internal locking tumbler that cooperates with a cam surface inside the lock and engages the cam surface in one or more detent positions, to preclude counterrotation. A release mechanism includes a special key or tool which engages the special locking tumbler and releases it from the cam surface detent position that precludes counterrotation. Upon such release the special locking tumbler and the lock plug may be manually or mechanically counterrotated. An alternative embodiment provides for a pawl (which assumes the function of the special locking tumbler) and ratchet mechanism (which assumes the function of the detent cam surface) that preclude counterrotation of the plug and key and which may be released by a pawl release tool or key.

Thus it is an object of the invention to provide a lock which is rotatable from the locked position toward the unlocked position and which is precluded from counterrotation back to the locked position pending release of the mechanism that precludes counterrotation.

It is a further objection of the invention to provide a lock mechanism which, when moved from the locked toward the unlocked position, is precluded from counterrotation but which may be released from a counterrotation by means of a separate tool or key.

It is a further object of the invention to provide a lock having a minimum number of parts yet which may be used to provide lock box security and control for various purposes include postal lock box control.

Yet another object of the invention is to provide a lock construction which enables a patron to utilize a customer key actuated lock on a one-time basis for removal of contents from a lock box.

Yet another object of the invention is to provide a lock construction having a minimum number of parts which is economical to manufacture, easy to use, and which may be used to provide lock box security for an institution.

These and other objects, advantages, and features of the invention will be set forth in the detailed description which follows.

BRIEF DESCRIPTION OF THE DRAWING

In the detailed description which follows, reference will be made with the drawing, comprised of the following figures:

FIG. 4 is an isometric view, similar to FIG. 3, wherein the reset key is depicted to effect removal of the lock from the door panel in which it is mounted;

FIG. 5 is a cross sectional view of the lock assembly of FIG. 1 as viewed from the backside depicting the internal components including a lock plug in the locked position;

DESCRIPTION OF THE PREFERRED EMBODIMENTS

The lock of the invention is especially designed for use in postal service lock boxes. It may be incorporated in original equipment mail lock boxes. Alternatively, existing doors may be retrofitted with the mechanism or replaced to provide the features associated with the described invention.

Figure 6:
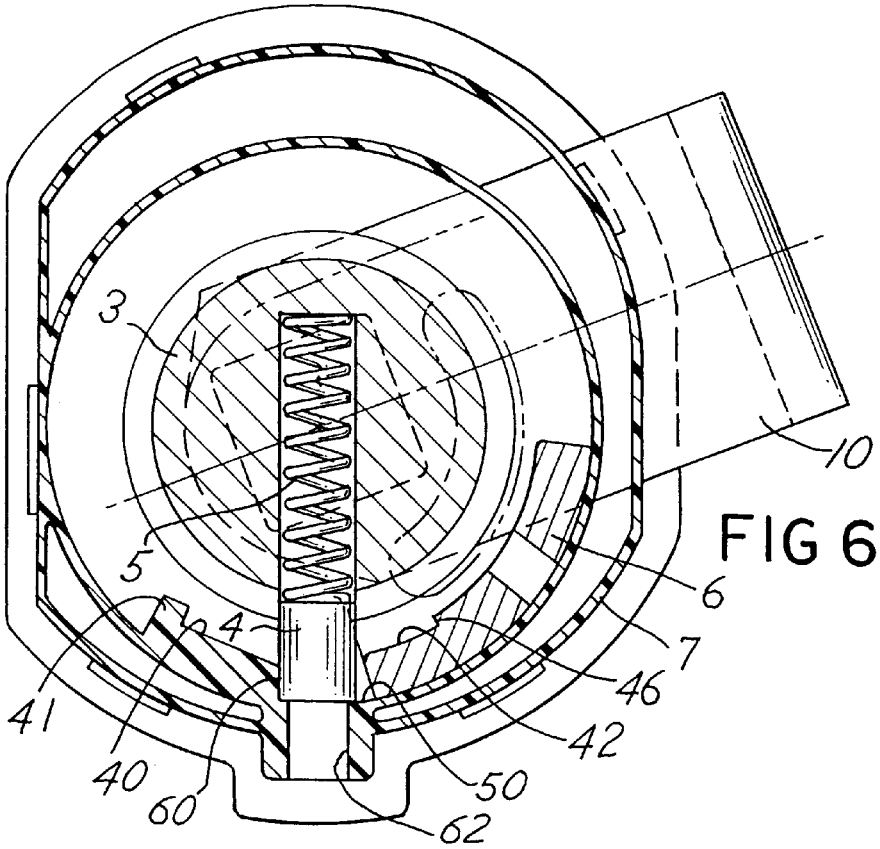
FIG. 6 is a cross sectional view, similar to FIG. 5, wherein the lock plug has been engaged by the operating key and rotated from the locked position toward the unlocked position.
Figure 7:
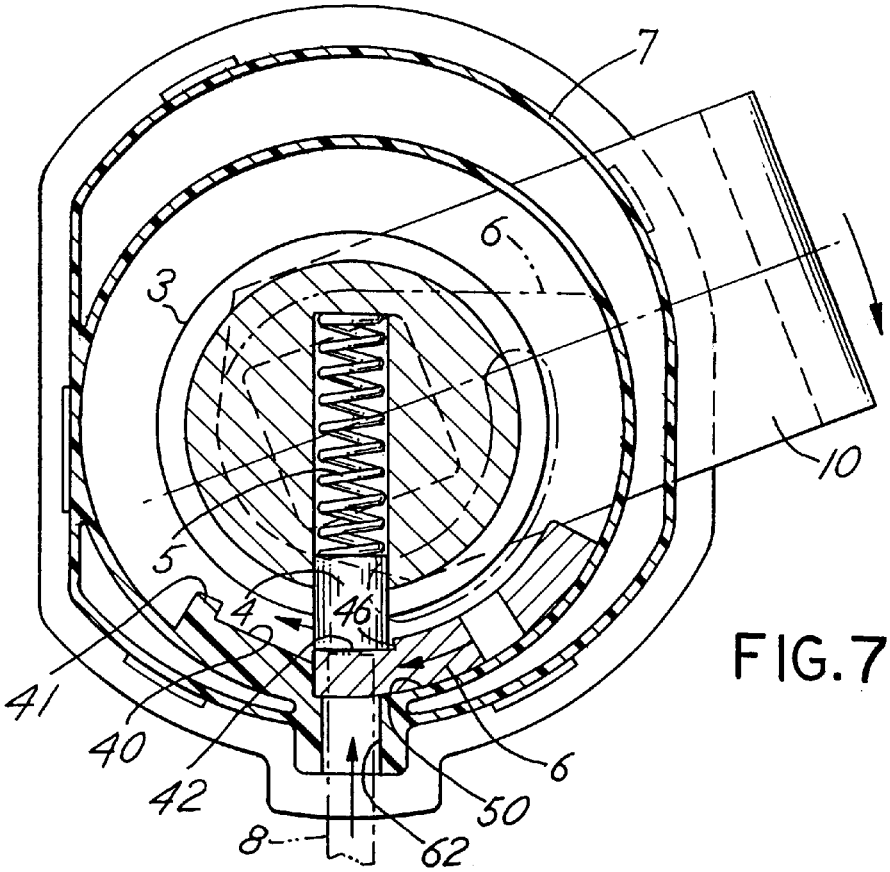
FIG. 7 depicts, in a cross sectional view, the lock wherein the lock of FIG. 5 with the operating key retained therein, has been released by a tool when in a position intermediate the full unlocked and full locked positions.
Figure 8:
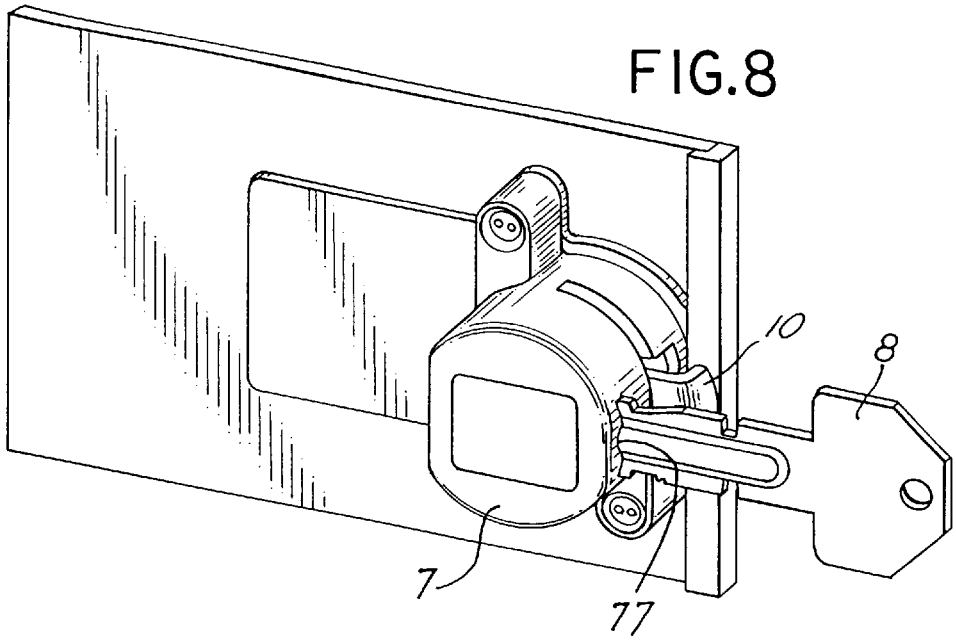
FIG. 8 is an isometric back view of an alternative key and lock release mechanism associated with a lock construction of the type shown in FIGS. 1–7.
Figure 9:
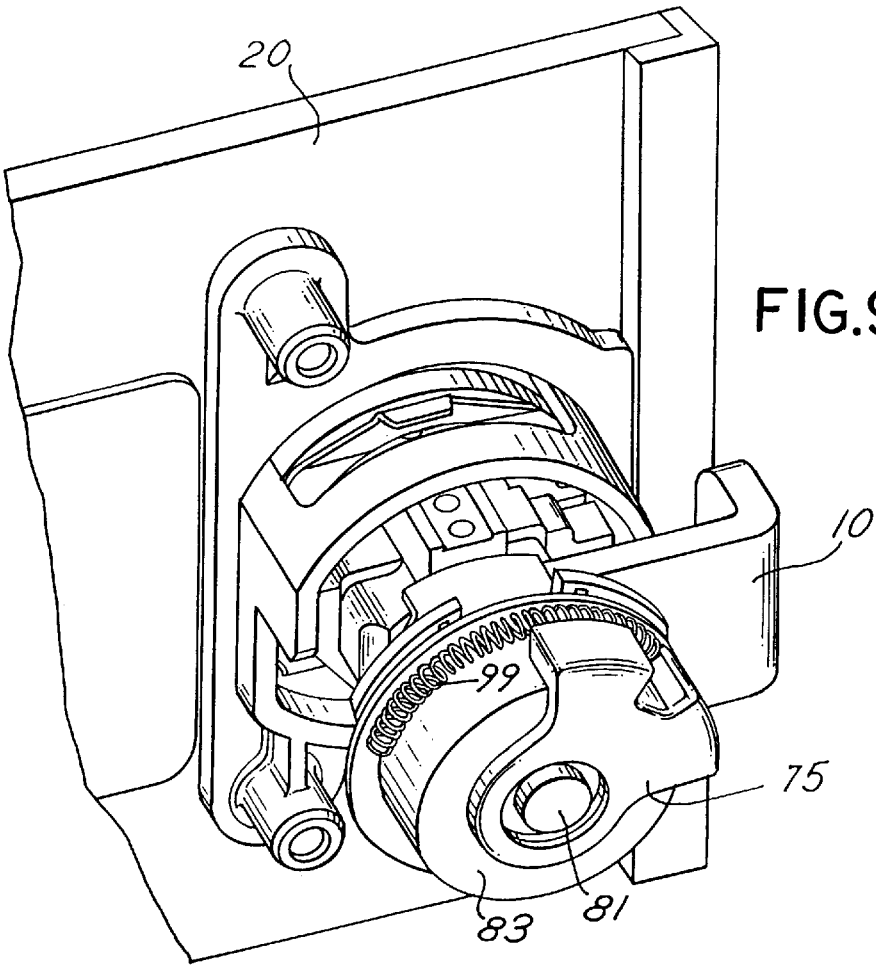
FIG. 9 is an enlarged isometric view of the mechanism of FIG. 8 wherein a release key is inserted to release the mechanism that prevents counterrotation of the lock from the unlocked toward the locked position.
Figure 10:
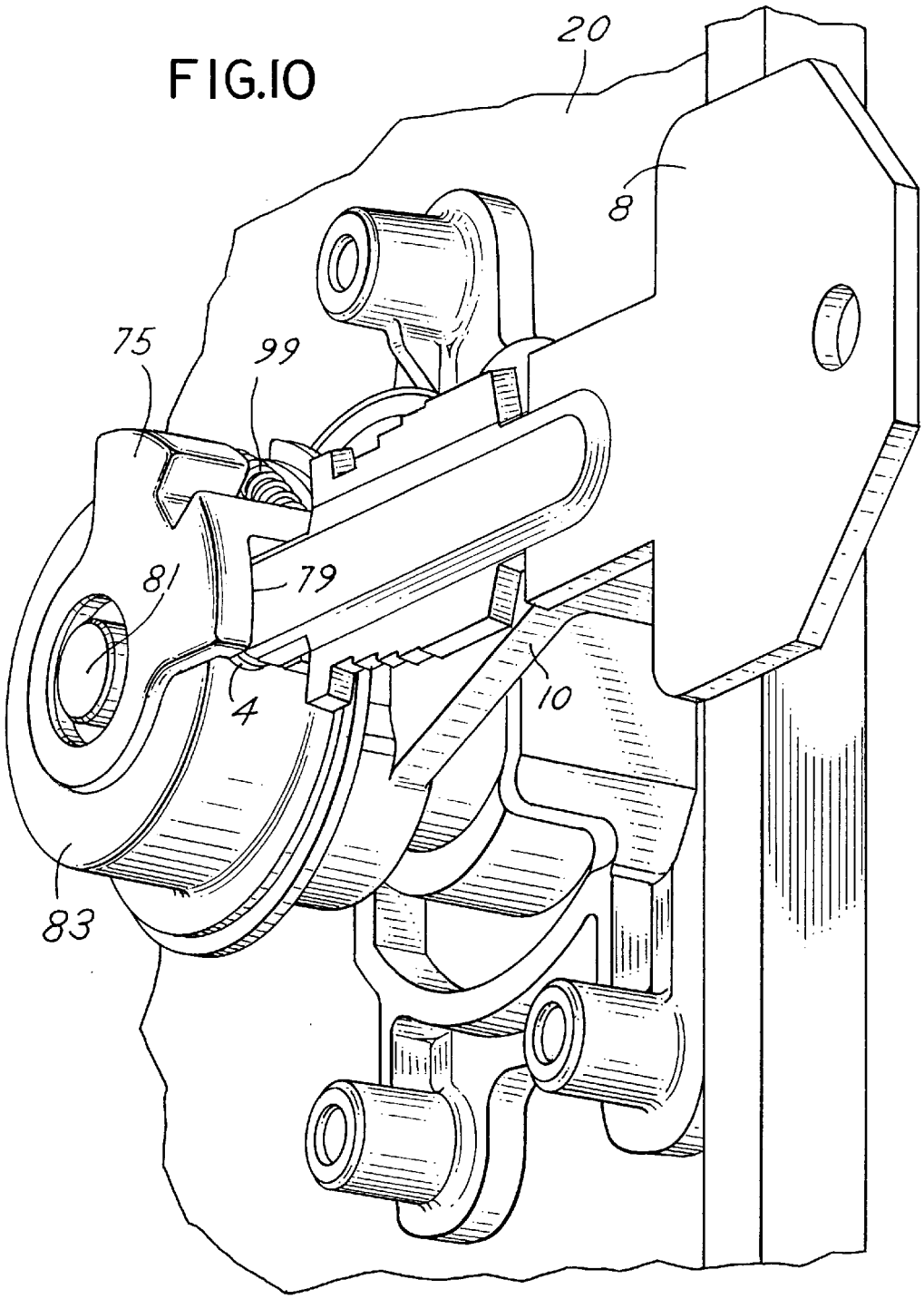
FIG. 10 is an isometric view of the lock of FIG. 8.
Figure 11:
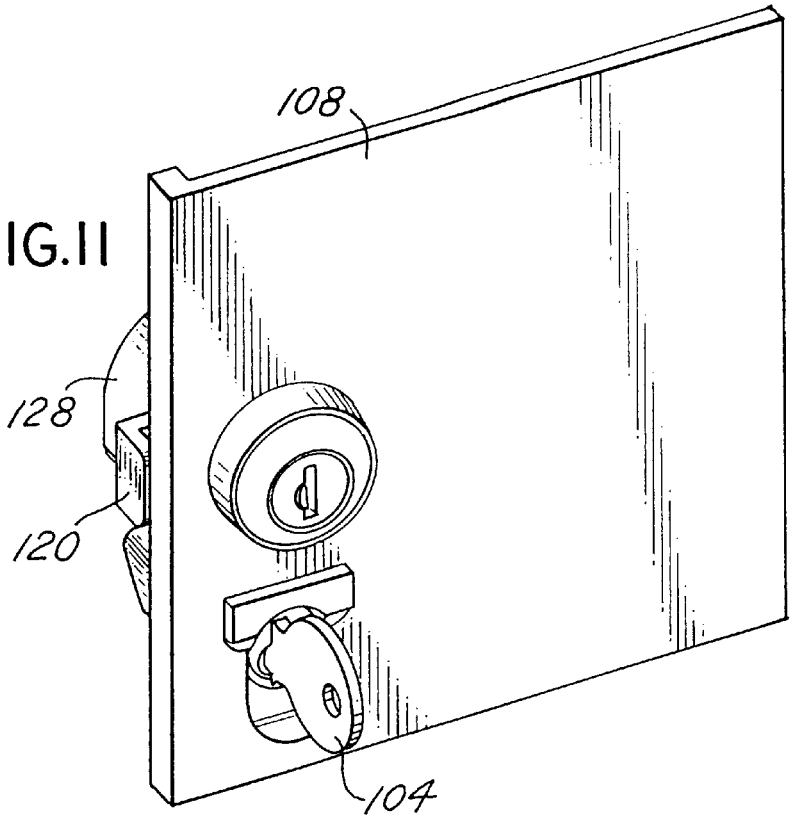
FIG. 11 is an isometric view of the installation of another alternative embodiment of the invention utilizing a customer lock and a reset lock and plug.
Figure 12:
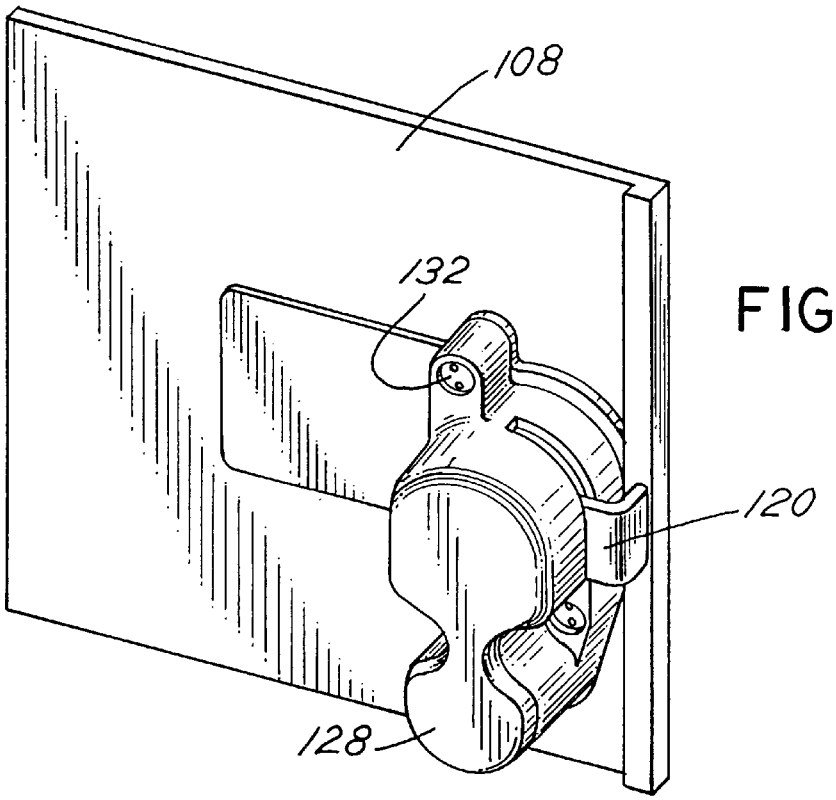
FIG. 12 is a back view of the lock construction of FIG. 11.

Referring to FIGS. 1–7, there is depicted a first embodiment. FIGS. 8, 9, and 10 illustrate a variation of the first embodiment. FIGS. 11–15 illustrate another embodiment of the invention.

Thus a lock box lock is operable by means of an operating, patron or customer key 30 which is inserted into the key slot in a rotatable plug of the lock when the lock box is in the locked condition and the lock box access door 20 in the closed position. Upon insertion of the customer operating key 30, the key 30 may be rotated to disengage a bolt 10 from a strike and open the lock box door 20. When the customer key 30 is rotated from the locked position toward the unlocked position, the customer key 30 remains retained by the locking mechanism and may not be removed until the plug is rotated back to the fully locked position. Retention of the customer key 30 is effected by various means known in the art including (1) engagement of a slot in the key 30 with a flange in the cylinder or face plate of the plug assembly or lock; (2) engagement of a locking tumbler or tumblers in the plug of the plug assembly with the key 30.

The lock of the invention includes a mechanism which prevents rotation of the operating or customer key 30 back to the fully locked position once the customer or operating key 30 is initially rotated to or toward the unlocked position. Thus a special tool or key 8 must be utilized to release the customer lock and permit the operating or customer key 30 to be rotated back to the fully locked position and removed. Consequently, in order for a worker to remove the customer key 30 from an open lock box door 20, the worker must first insert the special tool or key 8 into a separate opening 62 on the inside of the lock housing 7 to release the customer lock plug and an attached extension plug 3 to permit the customer lock plug to rotate to the fully locked and customer key release position. The worker may then rotate the customer plug to the fully locked position in order to remove the customer key 30. The invention relates specifically to the mechanism which restrains or prevents counterrotation of the customer plug and thus the customer key 30 of the lock to the fully locked position once that customer key 30 and plug have initially been rotated to or toward the unlocked position.

Figure 1:
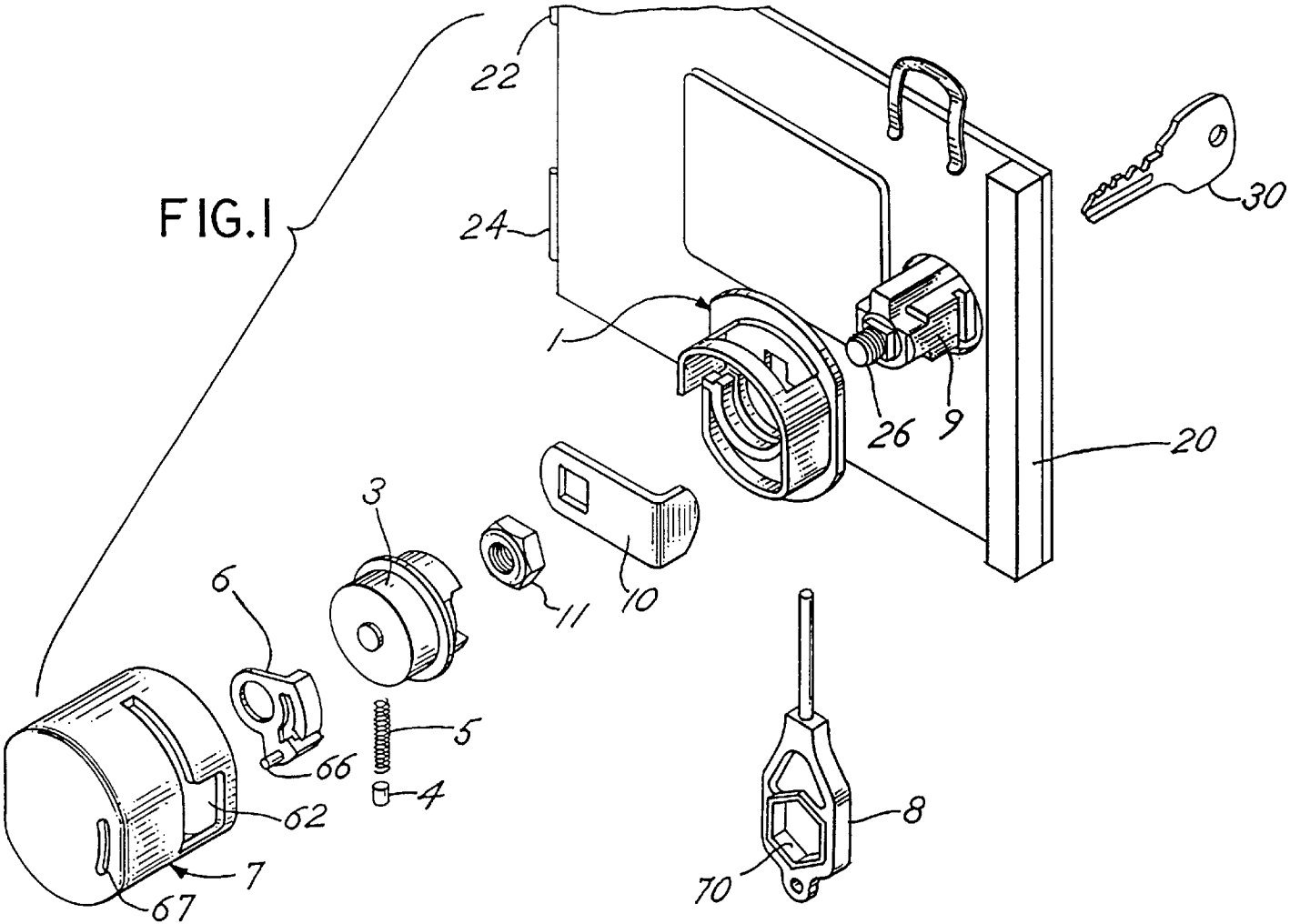
FIG. 1 is an exploded isometric view depicting the component parts of a first preferred embodiment of the lock.

FIG. 1 illustrates the component parts which comprise a first embodiment of the lock. A back plate 1 comprises part of a housing 7 and fits over a customer lock assembly 9. Lock assembly 9 fits through an opening in a lock box door 20. The lock box door 20 is mounted on hinges 22 and 24 of a lock box. Actuation by a customer key 30 fitted into the lock assembly 9 (i.e., into the rotatable plug with combinatable tumblers in a cylinder of a typical key operated lock assembly) will align tumblers within the plug of the lock assembly 9 permitting rotation of the plug in the assembly 9. The bolt 10 is held by a nut 11 on the threaded stud 26 of the rotatable plug of the lock assembly 9. A coaxial extension plug 3 within the housing 7 is fitted over and engaged by bolt 10 and will rotate simultaneously with bolt 10 to release the bolt 10 from a strike.

The special extension plug 3 carries an internal tumbler 4 biased radially outward in a radial passage 28 by a compression spring 5. The housing 7 further includes and contains a disconnector cam 6 rotatably and slidably mounted on the extension plug 3 as described in greater detail below.

The separate wrench/key tool 8 is provided for cooperation with extension plug 3 and tumbler 4 permitting manipulation of tumbler 4 in order to effect release of the operating key 30 that operates the lock assembly 9.

The lock assembly 9 is fabricated so that the operating or customer key 30 may be removed only when the key 30 is in the fully locked position through the front keyhole slot in the lock assembly 9. Rotation thereof to any other position precludes key 30 removal by virtue of a locking tumbler or retention flange, for example, associated with the lock assembly 9. Removal of the key 30 from the lock is prevented except when the key 30 has rotated the stud 26 and thus the cam or bolt 10 to the original locked position. Because such rotation is precluded, the customer key 30 cannot be removed. An unlocked and open door thus remains open and cannot be closed and locked.

Figure 2:
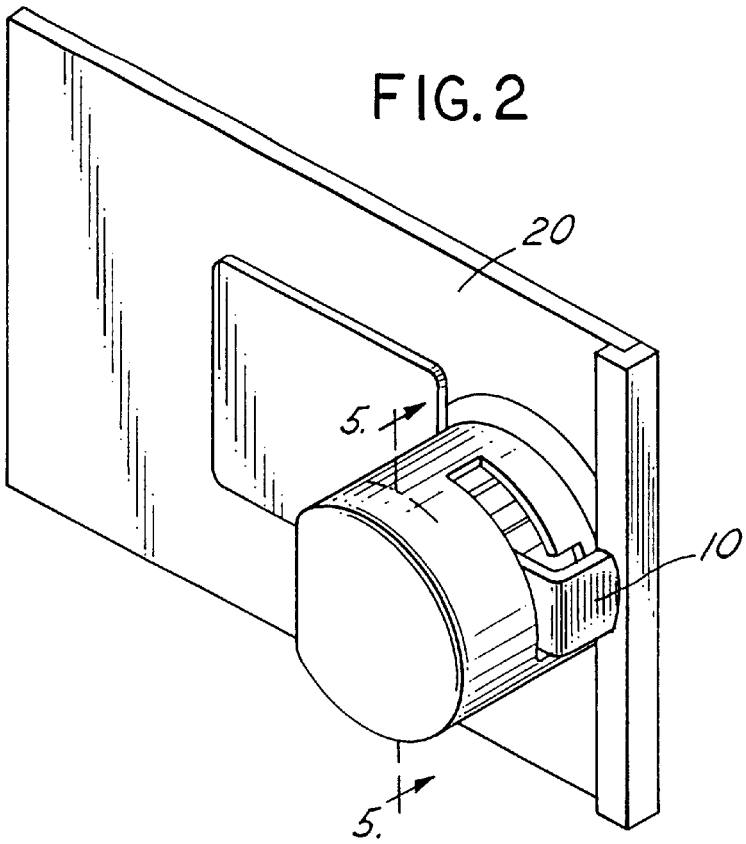
FIG. 2 is an isometric view of the lock of FIG. 1 in an assembled condition.
Figure 3:
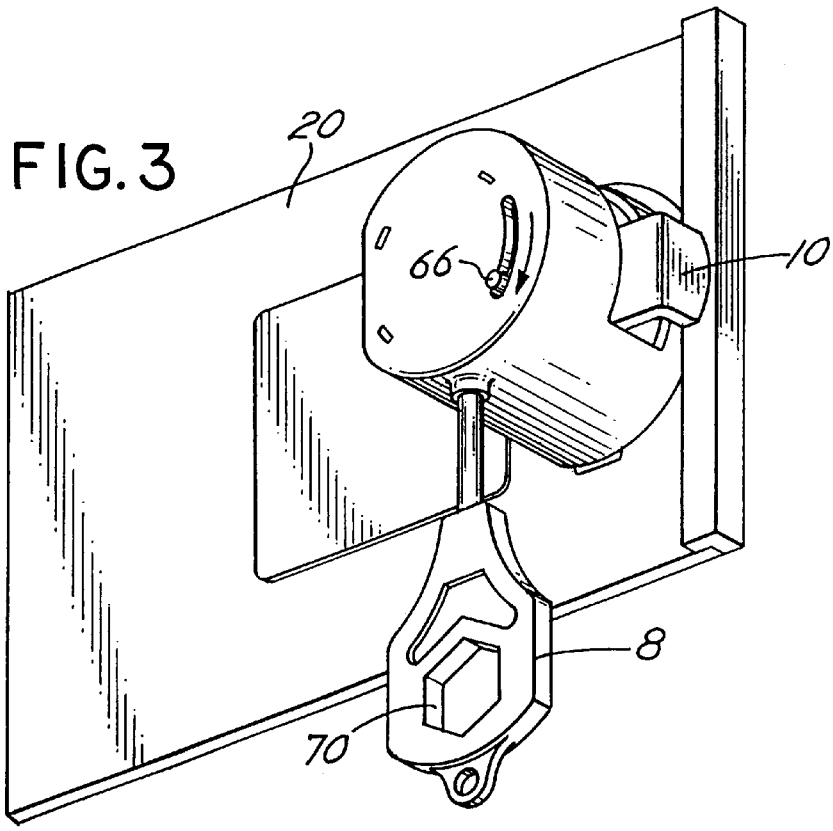
FIG. 3 is an isometric view of the lock of FIG. 2 wherein a reset tool has been inserted into the lock to permit the lock to be reset and thus permit an operating or customer key to be removed from the lock.

The component parts that preclude counterrotation are assembled and retained within the outer housing 7 as depicted in FIG. 2. FIGS. 5, 6 and 7 illustrate, in greater detail, the construction and operation of the lock retention and key release mechanism. Specifically, in FIG. 5, the extension plug 3 is designed to operate or rotate simultaneously and coaxially with rotation of a plug of lock assembly and a customer key 30. Thus extension plug 3 rotates about a central rotation axis with the key actuated plug of the lock assembly 9. The extension plug 3 includes a radial passage 28 which houses the outwardly biased tumbler 4 and a biasing or compression spring 5. In FIG. 5, the assembly is shown in the locked position wherein the cam or bolt 10 is engaged with a strike. When in this locked position, the tumbler 4 extends outwardly from the cylindrical outer surface of the extension plug 3 and lodges against a ledge 40 on the inside of the housing 7. The ledge 40 includes stop tab 41 which prevents counterrotation movement, but otherwise defines a tumbler 4 slide surface 40 which is arcuate so that the tumbler 4 may slide a short distance thereon, i.e., 21° of rotation clockwise from tab 41.

This amount of rotation may be adequate to disengage bolt 10 from a strike.

When the customer key 30 is inserted into the plug assembly 9, the plug assembly plug, and the extension plug 3 may both be rotated in the direction toward an unlocked position. This rotation causes the tumbler 4 to ride over the surface or ledge 40 to the position illustrated in FIG. 6. It is to be noted that a disconnector member 6, which includes a first arcuate ledge surface 42, a radial edge surface 44 which extends radially inwardly from the ledge 40, and a second edge surface 46 which extends radially inwardly from the ledge surface 42, is slidably mounted on an arcuate surface of the plug 3. Thus, when the plug 3 is rotated, the disconnector 6 is driven rotationally about the centerline axis by tumbler 4 with movement of the plug 3 from the position shown in FIG. 5 to the position shown in FIG. 6. Such rotation will cause the tumbler 4 to engage against the radial edge surface 44 of disconnector 6 moving the disconnector 6 out of position and enabling the tumbler 4 to be biased radially outwardly against the outer surface or a second arcuate ledge 50 on the inside of the outer housing 7. The disconnect member 6 is thus moved out of position so it will not interfere with the movement of the tumbler 4. Typically, the amount of rotation required to effect such movement between FIGS. 5 and 6 is in the range of 20° to 25° sliding along surface 40.

The extension plug 3 and the lock assembly 9 may then be further rotated to the fully unlocked position as depicted in FIG. 6 thereby totally releasing the cam or bolt 10 from a strike and permitting the door 20 to the lock box to be opened. During such full opening rotation, the tumbler 4 will ride on the arcuate second ledge 50 transporting with it the disconnector member 6. Full reverse rotation to effect removal of the key 30 from the plug assembly 9 is precluded or prevented because upon reverse rotation of the plug 3, the tumbler 4 will slide on surface 50, but then engage against stop surface 60. Note, in this position, cam 10 is still in the unlocked position so the lock box door 20 will remain open and unlocked during the release of the drive tumbler 4 described below.

Thus, it becomes necessary to drive the tumbler 4 radially inwardly against the biasing force of the compression spring 5 to enable counterrotation of the plug and plug extension 3 and removal of customer key 30. This is accomplished by means of a special tool or wrench key 8, shown in FIG. 1. The wrench key or tool 8 fits through an opening 62 in the outer housing 7 and is configured so that it will engage a top portion of the tumbler 4 to translate the tumbler 4 radially inwardly against the biasing force of the spring 5. When so translated radially inwardly, the tumbler 4 is in position to be maintained and held upon rotation of the disconnector member 6 (clockwise in FIG. 7). This rotation is effected inasmuch as the disconnector member 6 includes an arm 66 which projects through a slot 67 in the outer housing 7. The disconnector member 6 may thus be rotated manually by pushing on arm 66 in a direction to engage the ledge surface 42 thereof against the tumbler 4. When so engaged, tool 8 is removed and the plug extension 3 may be further counterrotated by key 30 causing the tumbler 4 to ultimately slide from the ledge surface 42 onto the ledge 40 as the disconnector member 6 engages against stop surface 60. The plug extension 3 and plug of plug assembly 9 may then continue to rotate by actuation of the customer key 30 with the tumbler 4 riding on the ledge 40 until it engages the stop 41. At this position, the key 30, along with all of the plug elements, including plug extension 3, are aligned with the key 30 being in the fully locked position wherein it may be removed from the lock. The cam 10, of course, has been simultaneously rotated to the fully locked position so that the lock box door is in a locked position and retained therein. Of course, wrench member or key 8 is removed after the disconnector member 6 is engaged with the tumbler 4 to hold tumbler 4 in a position which permits counterrotation. At that time, the door 20 may be closed. The wrench member 8 further includes a hexagonal opening 70 in FIG. 1 which acts as a socket to facilitate assembly and disassembly of the lock as depicted in FIG. 4.

In sum, the combination of the plug extension 3, tumbler 4, housing 7 and disconnector member 6 permit retention of the key 30 in the lock, except when the customer lock is in the locked or nearly locked position. Once the lock is unlocked, however, the customer key 30 cannot be removed unless and until the special wrench key 8 is utilized to disengage the tumbler 4 from interference with projections on the inside of the outer housing 7 and the disconnector member 6 is manually counterrotated.

FIGS. 8, 9 and 10 depict a variation of the mechanism disclosed in FIGS. 1–7. That is, in FIGS. 1–7 a disconnector member 6 is provided which is disengaged from the tumbler 4 and then manually moved in a counterrotational sense by manual actuation through engagement with the arm 66. In contrast the embodiment of FIGS. 8–10 provides for automatic counterrotational movement of a disconnector member 75 upon release of the tumbler 4 with the disconnector member 75 as a result of actuation by a release key 8.

Thus referring specifically to FIGS. 8–10 there is depicted a release key 8 which is fitted through a slot 77 in a housing 7. The release key 8 also fits through a slot 79 in a pivotally mounted disconnector 75. The disconnector 75 is mounted on a raised hollow boss 81 in housing 7 and rotates coaxially with the plug extension 83. That is, the disconnector 75 is driven by engagement of tumbler 4 with a lip or ledge 44 associated with the disconnector 75 and simultaneously in a rotational sense with the extension plug 83. Thus disconnector 75 comprises a cam having a shape and function as discussed with respect to the embodiment of FIGS. 1–7.

The plug extension 83 houses a tumbler 4 of a type again as discussed with respect to FIGS. 1–7. The tumbler 4 is spring biased radially outwardly and engages with the surfaces in plug extension 83 and the surfaces of disconnector 75. The tumbler 4 engages with a surface of the disconnector 75 to rotate the disconnector 75 in position as shown in FIG. 10. The disconnector 75 thus includes a slot 79 into which the key 8 may be inserted to engage the top face of tumbler 4. This causes the tumbler 4 to be released as previously described. A coil spring 99 which has one end attached to the plug extension 83 and the opposite end attached to the disconnector 75 then causes the disconnector 75 to counterrotate. Inasmuch as the disconnector 75 counterrotates by virtue of the action of the spring 99, the customer key 30 and associated plug may then be actuated to effect movement by counterrotation to the locking position. In other words, the embodiment of FIGS. 8–10 provides for an automatic reset feature that results from the design of the disconnector 75 which is driven in the counterrotational sense by the biasing spring 99.

FIGS. 11–15 illustrate another alternative embodiment of the invention. Referring to those figures, the customer lock 102 is operable by means of a first customer key 100. A reset key 104 cooperative with a reset lock assembly 106 is used to reset the lock 102 after the lock 102 is moved to the unlocked position and retained by the retention mechanism described below. That is, the customer lock 102 may be operated by the customer key 100 to move the lock 102 and the associated bolt from the locked to the unlocked position. When so moved, the lock 102 as well as the associated customer key 100 will remain in the unlocked position until released by actuation of the reset key 104. Actuation of the reset key 104 permits the customer lock 102 to be returned from the unlocked to the locked position. Once the customer reset key 104 is actuated to permit the relocking of the customer lock assembly 102, the reset key 104 may be removed from the reset lock 106.

Figure 13:
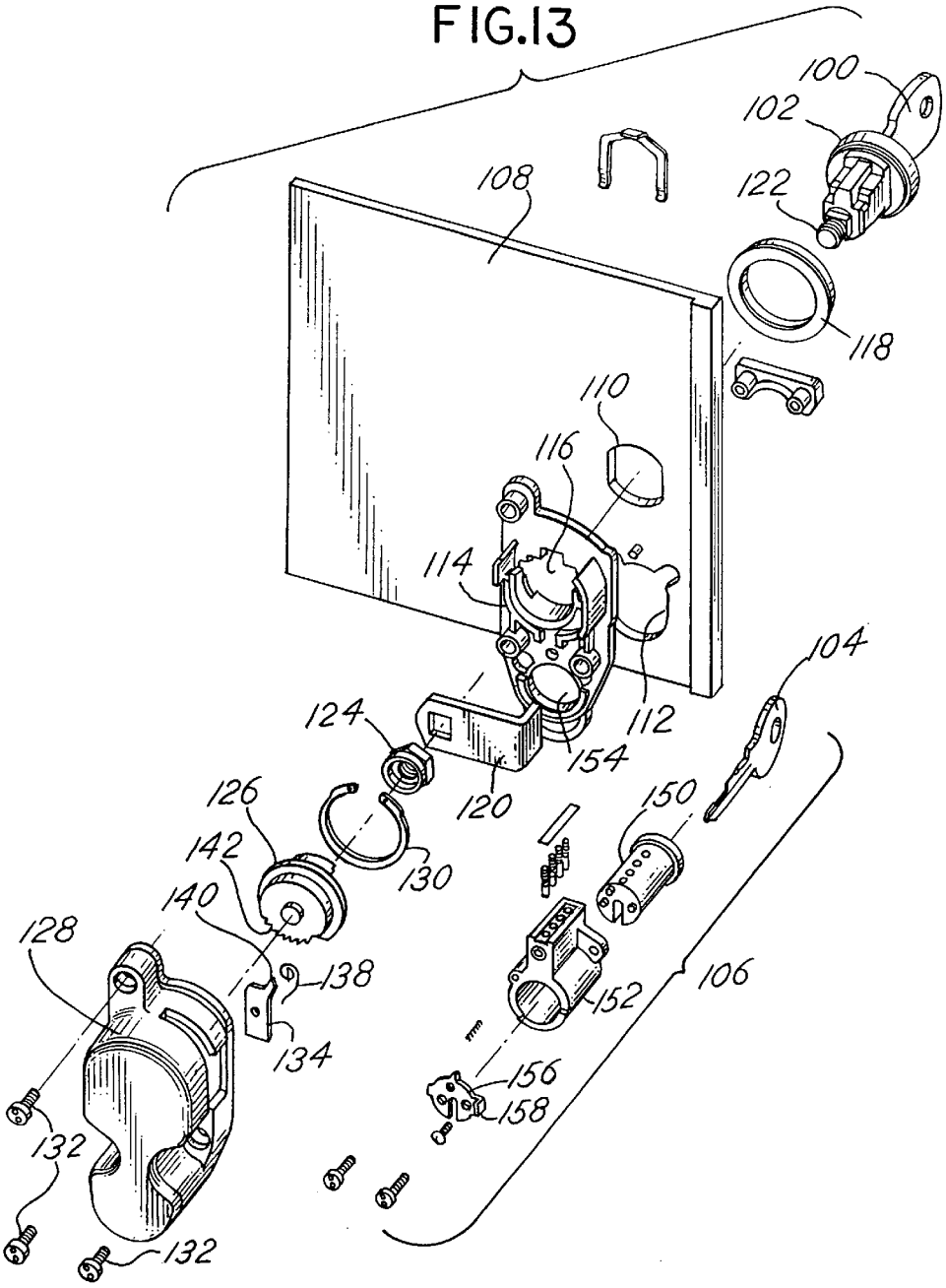
FIG. 13 is an exploded isometric view of the component parts of the lock construction of FIG. 11 as viewed from the backside.
Figure 14:
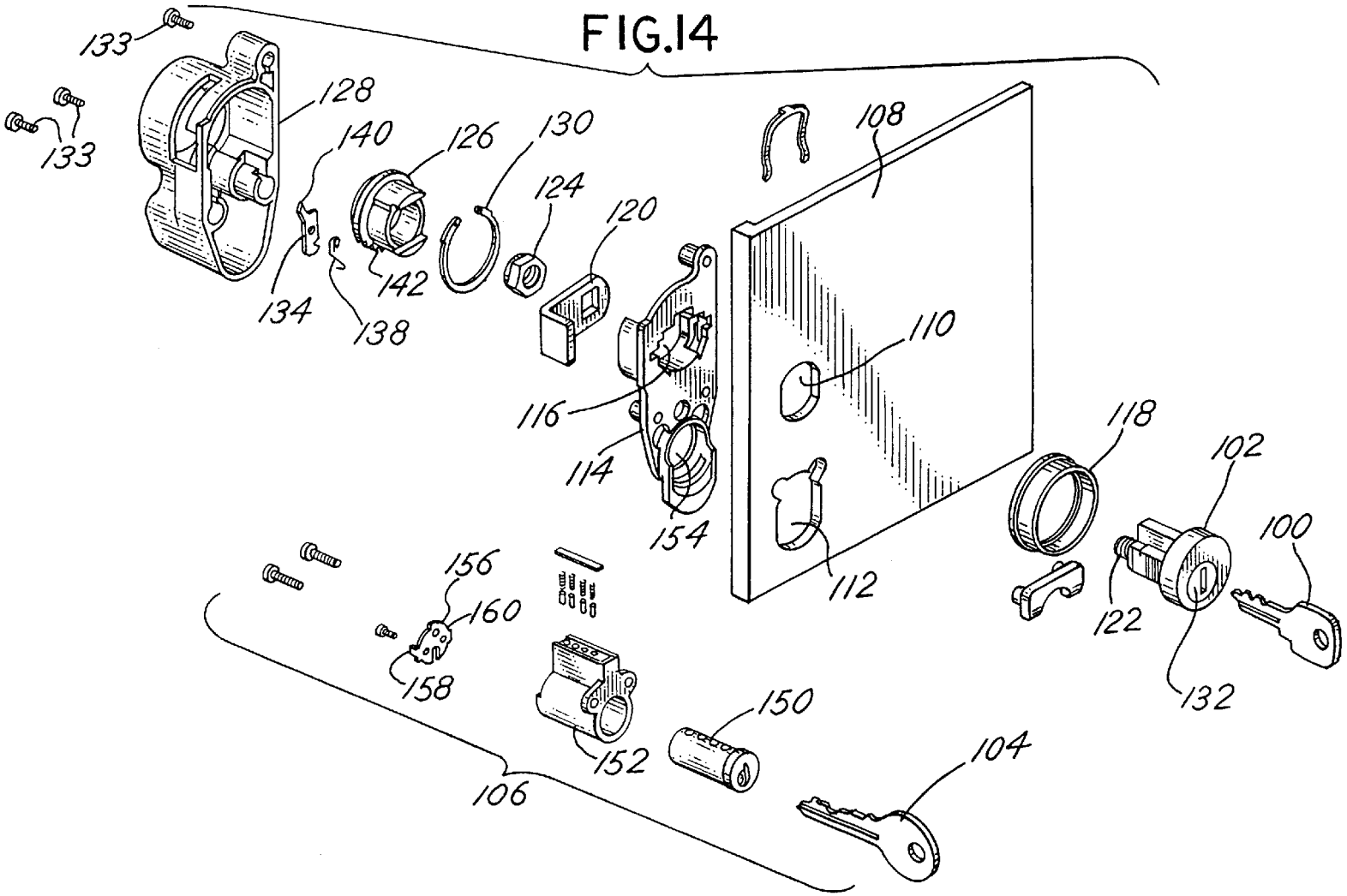
FIG. 14 is an exploded isometric view of the lock construction of FIG. 11 as viewed from the front side.

Referring further to FIGS. 13 and 14 there is depicted in exploded isometric views the third embodiment of the invention. The lock is designed for placement in a door or panel 108. The panel includes an upper opening 110 for receipt of the customer lock assembly 102 and a lower opening 112 for receipt of the reset lock assembly 106. A back plate 114 is positioned on the backside of the panel 108. The back plate 114 includes a through passage 116 for receipt of the customer lock assembly 102. Thus the customer lock assembly 102 fits through a protective collar 118 and into the opening 110 in the panel and then through the opening 116 in the back plate 114. A cam or bolt 120 is retained on a projecting stud 122 from the customer lock assembly 102 by a lock nut 124. A ratchet member 126 retained within a housing 128 by retaining ring 130 is engaged by the stud 122 and rotates therewith in response to actuation of plug 132 of lock assembly 102 by means of customer key 100. That is, insertion and rotation of the customer key 100 in plug 132 will cause stud 122 to rotate the cam or bolt 120 as well as the ratchet 126. The housing 128 retains the component parts in assembled condition inasmuch the housing 128 is attached to the back plate 114 by means of screws 133.

The ratchet 126 cooperates with a spring biased pawl 134 pivotally mounted on the back plate 114 biased for pivotal motion about a pivot mounting pin 136 by means of a torsion spring 138.

The pawl 134 includes a projecting tooth 140 which engages with separate teeth 142 of ratchet 126 as the customer key 100 is rotated from the locked to the unlocked position. Inasmuch as the key 100 is removable from the plug 132 only in the fully locked position, the key 100 is trapped in the plug 132 and cannot be removed until a release mechanism is operated in order to release the ratchet 126 from the pawl 134.

Figure 15:
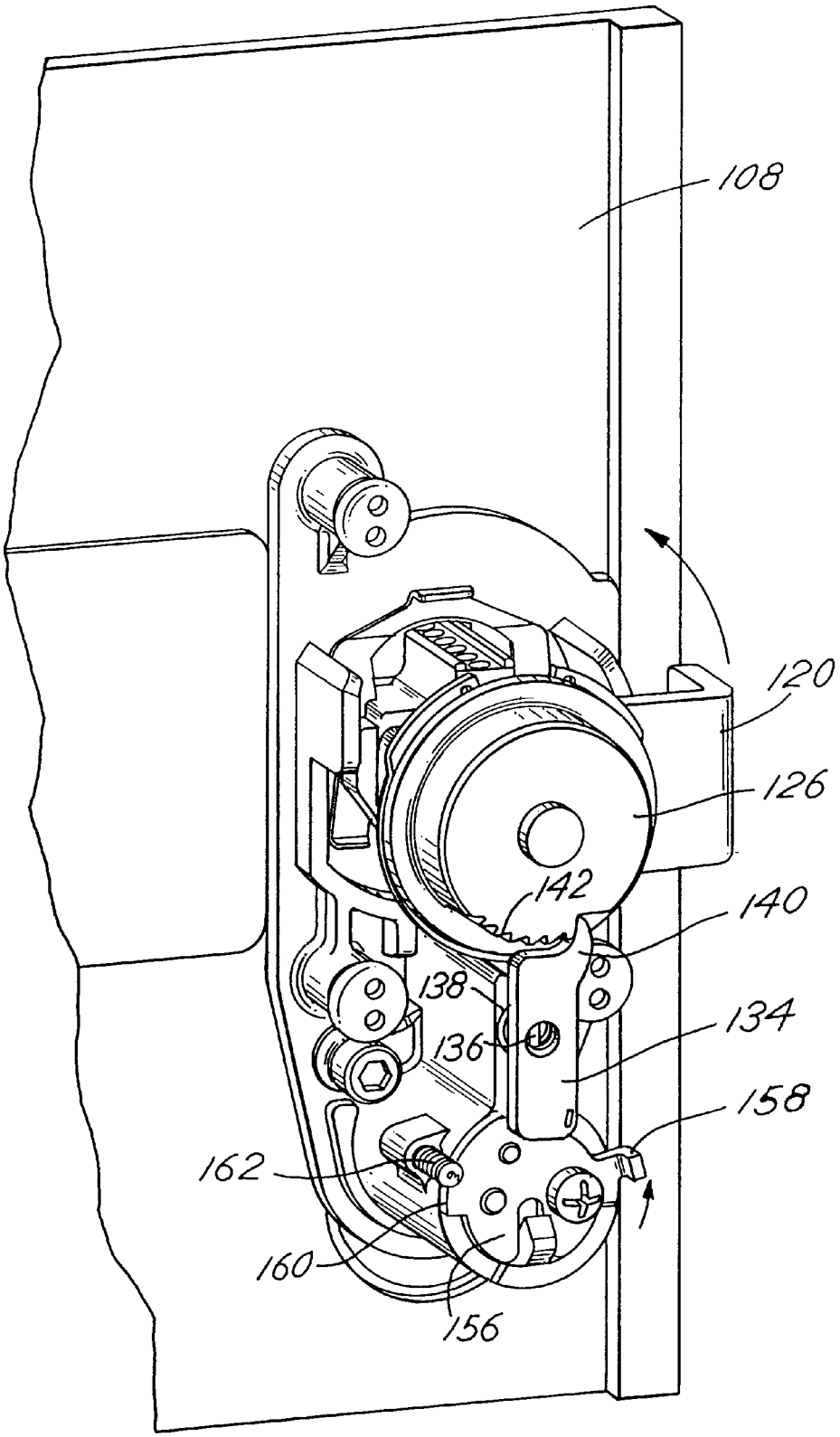
FIG. 15 is an isometric view of the lock of FIG. 11 as viewed from the back side with the cover or housing removed.

The mechanism for release of the ratchet 126 from the pawl 134 is associated with the reset assembly 106 which includes the reset key 104 that engages a reset plug 150 rotatably mounted in the reset cylinder 152 which is mounted in the opening 112 of the panel 108 and extends into opening 154 of back plate 114. A reset plate 156 is mounted for rotation on plug 150 and thus rotates in response to rotation of plug 150 effected by reset key 104. The reset plate 156 includes an actuating arm or tab 158 as shown in FIG. 15 which upon rotation of the plug 150 and concurrent rotation of the plate 156 engages the lower arm or extremity of the pawl 134 causing it to pivot about the axis or pin 136 against the biasing force of the spring 138 thereby disengaging tooth 140 from the teeth 142 associated with the ratchet 126. When so disengaged, the customer lock 102 and more particularly the plug 132 may be rotated to the locked position by the customer key 100 and the customer key 100 may then be removed from the plug and cylinder 132, 102. The reset key 104 may also be rotated to its original position and removed.

The reset plate 156 has a camming outer rim or periphery 160 which engages a spring member 162. The spring member 162 engages the rim 160 and provides a detent mechanism to hold the reset plate 156 in a generally fixed position until the detent force derived from spring member 162 is overcome by twisting reset key 104. As a result of this feature, a worker involved in resetting the lock can do so with one hand since the reset key 104 will be maintained in a fixed position once the key 104 is actuated to release pawl 134.

In operation the reset lock assembly 106 is arranged in a manner where the actuating arm 158 associated with the plate 156 is disengaged from the pawl 134. Spring member 162 acts to retain the plate 156 in that position. The customer lock comprised of the plug 132 and the cylinder 102, being in the locked position, may be moved by actuation of customer key 100 to the unlocked position. Movement to the unlocked position prevents removal of the customer key 100 and further prevents relocking of the panel 108 because of the interaction of ratchet 142 and pawl 134. The pawl 134 and ratchet 142 may then be released one from the other by operation of the reset key 104 to rotate the plug 150 and plate 156 as described.

Various mechanisms have been disclosed for retaining a customer lock in the unlocked position until some means is utilized to permit counterrotation or reversal of the customer lock back to the locked position from the unlocked position. Thus the invention is to be limited only by the following claims and equivalents thereof.

What is claimed is:

1. In a lock including a housing, a lock assembly having a key actuated, rotatable plug, said plug including a key slot for receipt of a customer key to engage the plug to thereby effect rotation of the plug, a bolt attached to the plug and rotatable therewith between a fully locked, key removal position and an unlocked position, said lock including means to prevent removal of the customer key except when the plug is in the fully locked position, the improvement comprising means for preventing the plug from moving to the fully locked position subsequent to actuation of the lock by said customer key by rotating the plug within the housing from the fully locked toward an unlocked position, said means for preventing including a biased tumbler mounted for rotation with the plug, said biased tumbler being biased toward engagement with the housing, said housing including a first surface for engaging the biased tumbler in the fully locked position and a second surface for engaging the biased tumbler in a position other than in the fully locked position, said first and second surfaces separated by a stop surface which engages the biased tumbler and precludes rotation of the plug to the fully locked position; and releasing means to disable the means for preventing thereby permitting rotation of the plug to the fully locked position and subsequent removal of the customer key.

2. The lock of claim 1 further including a disconnect member for engaging the biased tumbler and for disengaging the biased tumbler from the second surface and the stop surface.

3. The lock of claim 2 wherein the disconnect member comprises a rotatable cam in the housing and a biasing member for providing a biasing force on the rotatable cam in a rotational sense toward the locking position.

4. The lock of claim 2 or 3 further including a tool for engaging the biased tumbler to disengage the biased tumbler from the second surface.

5. The lock of claim 1 further including a rotatable cam in the housing, said cam including a third surface for engaging and holding the biased tumbler disengaged from the second surface subsequent to engagement by the tool.

6. The lock of claim 2 wherein the disconnect member comprises a rotatable cam in the housing, said cam including a lever arm extendable from the housing.

7. The improvement of claim 1 wherein the means for preventing comprise a pawl mounted on the housing and a ratchet mounted on the plug, and said releasing means comprise a second key actuated plug with a pawl and ratchet release plate operative to disengage the pawl from the ratchet upon rotation of the second key actuated plug.

8. In a lock including a housing, a first rotatable customer key actuated plug in the housing having a locked and an unlocked position and rotatable about a plug axis, the improvement comprising releasable means for preventing the plug from counterrotation upon the rotation from the locked position, said means including a ratchet mounted on the first plug rotatable in response to rotation of the first plug from the locked toward the unlocked position;

a pawl mounted in the housing biased for engagement with the ratchet to preclude counterrotation of the first plug; and a separate, second key actuated plug member including a pawl and ratchet release plate mounted thereon and rotatable in response to second key actuated rotation of the second plug; and a pawl engaging member to engage and release the pawl from the ratchet up rotation of the second plug between a pawl engage and pawl release position.

9. The improvement of claim 8 further including a detent mechanism for the pawl engaging member.

* * * * *